US010907822B2

(12) United States Patent
Takenaka et al.

(10) Patent No.: US 10,907,822 B2
(45) Date of Patent: Feb. 2, 2021

(54) WASTE HEAT BOILER

(71) Applicants: Anhui Conch Kawasaki Engineering Company Limited, Anhui (CN); KAWASAKI JUKOGYO KABUSHIKI KAISHA, Kobe (JP); Anhui Conch Kawasaki Energy Conservation Equipment Manufacturing Company Limited, Anhui (CN)

(72) Inventors: Yukihiro Takenaka, Anhui (CN); Fengwa Zhao, Anhui (CN); Chuanli Kao, Anhui (CN); Tatsuo Ino, Anhui (CN); Mihan Zhao, Anhui (CN); Takuro Nozoe, Anhui (CN); Hao Zhang, Anhui (CN); Xiaobing Wang, Anhui (CN); Ning Wang, Anhui (CN); Jieyu Xiao, Anhui (CN); Wei Fang, Anhui (CN); Dazhu Liu, Anhui (CN); Jian Zhou, Anhui (CN)

(73) Assignees: ANHUI CONCH KAWASAKI ENGINEERING COMPANY LIMITED, Wuhu (CN); KAWASAKI JUKOGYO KABUSHIKI KAISHA, Kobe (JP); ANHUI CONCH KAWASAKI ENERGY CONSERVATION EQUIPMENT MANUFACTURING COMPANY LIMITED, Wuhu (CN)

( * ) Notice: Subject to any disclaimer, the term of this patent is extended or adjusted under 35 U.S.C. 154(b) by 0 days.

(21) Appl. No.: 15/550,927

(22) PCT Filed: Feb. 6, 2016

(86) PCT No.: PCT/CN2016/073724
§ 371 (c)(1),
(2) Date: Aug. 14, 2017

(87) PCT Pub. No.: WO2016/127937
PCT Pub. Date: Aug. 18, 2016

(65) Prior Publication Data

US 2018/0023806 A1 Jan. 25, 2018

(30) Foreign Application Priority Data

Feb. 12, 2015 (CN) ..... 2015 1 0076305
Feb. 12, 2015 (CN) ..... 2015 2 0104147

(51) Int. Cl.
*F22B 1/18* (2006.01)
*F28F 9/013* (2006.01)
(Continued)

(52) U.S. Cl.
CPC ..... *F22B 1/1876* (2013.01); *F01K 23/10* (2013.01); *F28F 1/126* (2013.01); *F28F 9/013* (2013.01);
(Continued)

(58) Field of Classification Search
CPC ..... F22B 1/1876; F01K 23/10; F28F 9/013; F28F 1/126; F28G 15/04
See application file for complete search history.

(56) References Cited

U.S. PATENT DOCUMENTS 2,696,016 A * 12/1954 De Mart ..... F23J 3/00 122/392
3,885,530 A 5/1975 Kivlen et al.
(Continued)

FOREIGN PATENT DOCUMENTS

CN 201603719 U 10/2010
CN 102261854 A 11/2011
(Continued)

OTHER PUBLICATIONS

Oct. 31, 2018 Office Action issued in Chinese Patent Application No. 201680010054.1.
(Continued)

*Primary Examiner* — Steven S Anderson, II
(74) *Attorney, Agent, or Firm* — Oliff PLC

(57) ABSTRACT

The present provides a waste heat boiler and a hammering device, a heating tube mounting structure thereof. The waste heat boiler which a boiler, heating tubes provided in the boiler and a hammering device; the boiler is provided with an exhaust gas inlet and an exhaust gas outlet; the heating tubes are in a horizontal grid tube arrangement; a surface of the heating tubes is provided with fins, and the heating tubes are connected to support assemblies in an unfixed way.

16 Claims, 5 Drawing Sheets

(51) Int. Cl.

| | |
|---|---|
| ***F28G 15/02*** | (2006.01) |
| ***F28G 7/00*** | (2006.01) |
| ***F28G 15/04*** | (2006.01) |
| ***F01K 23/10*** | (2006.01) |
| ***F28G 1/12*** | (2006.01) |
| ***F28F 1/12*** | (2006.01) |

(52) U.S. Cl.
CPC ..... *F28G 7/00* (2013.01); *F28G 15/02* (2013.01); *F28G 15/04* (2013.01)

(56) References Cited

U.S. PATENT DOCUMENTS

| | | | | | |
|---|---|---|---|---|---|
| 3,929,189 | A | * | 12/1975 | Lecon | F22B 37/202 165/69 |
| 3,997,000 | A | * | 12/1976 | Piela | F28G 7/00 165/84 |
| 4,013,024 | A | * | 3/1977 | Kochey, Jr. | F22B 37/202 110/349 |
| 4,442,800 | A | | 4/1984 | Seifert et al. | |
| 4,991,648 | A | * | 2/1991 | Magari | B01J 8/067 165/159 |
| 5,238,055 | A | * | 8/1993 | Kelley | F28G 7/00 122/379 |
| 5,540,275 | A | * | 7/1996 | Eisinger | F28G 7/00 122/361 |
| 5,615,953 | A | * | 4/1997 | Moskal | G01N 25/72 134/167 C |
| 5,697,426 | A | * | 12/1997 | Matuszczak | F28F 9/0136 165/162 |
| 2006/0008394 | A1 | | 1/2006 | Muramoto et al. | |

FOREIGN PATENT DOCUMENTS

| | | | | | |
|---|---|---|---|---|---|
| CN | 103994450 | A | | 8/2014 | |
| CN | 2015-03082 | U | * | 10/2014 | |
| CN | 203907577 | U | | 10/2014 | |
| CN | 104696937 | A | | 6/2015 | |
| CN | 204460151 | U | | 7/2015 | |
| CN | 204460245 | U | | 7/2015 | |
| CN | 204460247 | U | | 7/2015 | |
| DE | 1138794 | B | | 10/1962 | |
| EP | 0281151 | B1 | | 8/1994 | |
| JP | S50-29559 | U | | 4/1975 | |
| JP | S57-108586 | U | | 7/1982 | |
| JP | S59-41797 | A | | 3/1984 | |
| JP | 59142399 | A | * | 8/1984 | B60C 11/0309 |
| JP | S62-49115 | A | | 3/1987 | |
| JP | S62-252817 | A | | 11/1987 | |
| JP | H05-106408 | A | | 4/1993 | |
| JP | 5029559 | Y2 | * | 7/1993 | |
| JP | H09-280540 | A | | 10/1997 | |
| JP | H10-122501 | A | | 5/1998 | |
| JP | 2001-12896 | A | | 1/2001 | |
| JP | 2002-295989 | A | | 10/2002 | |
| JP | 3114369 | U | | 10/2005 | |
| WO | 2004/042280 | A1 | | 5/2004 | |
| WO | 2015/001666 | A1 | | 1/2015 | |

OTHER PUBLICATIONS

Oct. 31, 2018 Search Report issued in Chinese Patent Application No. 201680010054.3.
Jan. 22, 2019 Extended Search Report issued in European Patent Application No. 16748738.8.
Feb. 1, 2016 Office Action issued in Chinese Patent Application No. 201510076305.5.
Aug. 24, 2016 Office Action issued in Chinese Patent Application No. 201510076305.5.
Jun. 12, 2018 Office Action issued in Japanese Patent Application No. 2017-560862.
Oct. 2018 Office Action issued Japanese Patent Application No. 2017-560862.
Nov. 8, 2016 Search Report issued in International Patent Application No. PCT/CN2016/073724.
Nov. 8, 2016 Written Opinion issued in International Patent Application No. PCT/CN2016/073724.
Mar. 3, 2020 Office Action issued in Japanese Patent Application No. 2018-170790.
Oct. 2019 Office Action issued in Chinese Patent Application No. 201680010054.3.
Jun. 25, 2019 Office Action issued in Japanese Patent Application No. 2018-170790.
Jun. 25, 2019 Office Action issued in Chinese Patent Application No. 201680010054.3.
Jul. 16, 2019 Office Action issued in Indian Patent Application No. 201717031438.
Jul. 31, 2020 Office Action issued in European Patent Application No. 16748738.8.

* cited by examiner

WASTE HEAT BOILER

TECHNICAL FIELD

The present invention relates to boiler equipment, and particularly, to a waste heat boiler capable of recovering waste heat in exhaust gas.

BACKGROUND ART

Currently, the waste heat boiler is widely used to recover waste heat generated in the manufacturing industries such as carbon black production, glass fiber production, metallurgy steel production, petroleum production, acid and alkali production, cement production, etc.

Now the waste heat boiler capable of recovering waste heat in exhaust gas of the cement production kiln in the cement industry is used as an example to describe the waste heat boiler.

The waste heat boiler matched with the cement production kiln mainly includes an AQC boiler (Air Quenching Cooler boiler), a PH boiler (Pre heater boiler), etc. The heat transfer performance and energy consumption rate of the waste heat boiler mainly depend on the heating tube.

The heating tube includes the unfinned heating tube (bare tube) and the finned heating tube (finned tube).

The bare tube has a smooth outer surface and the heat transfer is quick, while the flow resistance to exhaust gas is small and the energy consumption is low, thus it is widely used in the PH boiler, etc. The exhaust gas in the PH boiler has a temperature of 300° C. to 400° C., and a high dust concentration of 100 g/Nm3. The dusts of such a concentration will not be melted within the temperature zone of 300° C. to 400° C., while their particle size is very small (the dusts with the average particle size below 10 μm occupy 80%) and textures are soft, thus the bare tube is used. If the grid tube arrangement is employed, the dusts will block spaces between the heating tubes in the flow direction, and the heat transfer is degraded. In the case of staggered tube arrangement, turbulences will be caused when the gas flow enters, thus the dust blocking can be avoided, so the staggered arrangement is popular. However, in the staggered arrangement, dusts still can be easily adhered to the surface of the heating tube. Therefore, the PH boiler is usually provided with a hammering device or a soot blowing device to clean the dusts adhered to the surface of the heating tube. One type of rapping device hammers the lower portions of heating tubes arranged vertically, and another type of rapping device raps the accessories fixed to the lower portions of heating tubes arranged horizontally. However, in the above two types of rapping structures, the heating tube and the mounting accessory are fixedly connected to each other, rather than movable to each other, thus the vibration is insufficient. In addition, the mounting accessory for mounting the heating tube will bear an impact force from the hammering device, and the durability of the waste heat boiler is weakened. In addition, in these existed rapping devices, the rapping effect cannot be sufficiently achieved, and the mounting accessory will be easily affected by the impact force of the rapping in the case of the whole tube bundle of all the heating tubes being rapped. However, the cost rises when each heating tube is provided with a rapping device.

In addition, although the soot blowing device is provided as dedusting means, the dusts in the exhaust gas of the PH tower among the exhaust gas of cement are of a large quantity and a high adhesiveness, which requires frequent operations and the economic feasibility is poor, thus the soot blowing device is not widely used.

The finned tube is adopted in the AQC boiler. The heat exchange area is greatly increased, and under the condition of obtaining equivalent heat exchange performances, the number of the heating tubes is small, the volume of the boiler is largely decreased, and the cost is reduced in case of adopting finned tube. The fins of the finned tube of the AQC boiler are usually spiral fins. The AQC boiler uses the finned tube in the reason that the exhaust gas is filtered by a dust collector before it enters the AQC boiler, with a temperature of 300° C. to 400° C., a dust concentration decreased to be not more than several g/Nm3, and mainly including relatively large and hard dusts with particle sizes not more than 200 μm, i.e., the dusts will not be easily adhered to the surface of the heating tube. Regarding the AQC boiler, since the dusts have low adhesiveness, usually a staggered arrangement is adopted without the rapping device.

The comparison between the bare tube and the finned tube is as follows. Although the bare tube achieves a quick heat transfer and a low energy consumption, the volume or number of the heating tube has to be increased if the heat transfer area needs to be expanded, thus the cost of the heating tube and even the whole boiler will be increased. Although the finned tube can largely improve the heat transfer performance, the dusts will be easily adhered thereto because smoothness of the surface of the heating tube is damaged. And the adhered dusts can easily block the spaces between the fins and the boiler cannot run stably. Meanwhile, the exhaust gas has a large flow resistance and a high energy consumption. Currently, the general design idea is that the bare tubes are used in cooperation with dedusting devices such as the rapping device and the soot blowing device, and applied to the waste heat boilers for the exhaust gas in which the temperature is moderate, the dust concentration is high, and the dusts have small particle sizes and high adhesiveness; the finned tubes are applied to the waste heat boilers for the exhaust gas in which the temperature is high, the dust concentration is low, and the dusts have large particle sizes and low adhesiveness, and which does not need to provide dedusting devices such as the rapping device and the soot blowing device. However, under the above design idea, the various types of waste heat boilers existed at present cannot economically recover the exhaust gas in which the temperature is high, and the dusts have very small particle sizes and high adhesiveness, such as the exhaust gas of a ferrosilicon manufacturing electric furnace. The reason is that the exhaust gas of the ferrosilicon manufacturing electric furnace has a temperature of 400° C. to 450° C., a dust concentration lower than 10 g/Nm3, while the dusts have tiny particle sizes (60% of them are not more than 1 μm) and high adhesiveness. Since the temperature of the exhaust gas of the ferrosilicon manufacturing electric furnace is high, the heat transfer area of the bare tube cannot be economically and sufficiently ensured if the recovery is made with a waste heat boiler provided with the bare tubes, and the exhaust gas still maintains a high temperature after being discharged from the waste heat boiler, thus the heat cannot be sufficiently recovered. Meanwhile, the dusts in the exhaust gas of the ferrosilicon manufacturing electric furnace have high adhesiveness, thus more dusts are accumulated between the heating tubes if the recovery is made with an AQC waste heat boiler provided with the finned tubes. In addition, the rapping device is usually not provided, thus the heat transfer performance of the waste heat boiler will be continuously degraded with the incessant adhesion of the dusts.

That is to say, various types of waste heat boilers in the market, including the PH boiler and the AQC boiler, cannot effectively recover waste heat of the exhaust gas in which the temperature is 300° C. to 500° C., the dust concentration is 10 g/Nm3 to 100 g/Nm3, and the dusts have high adhesiveness. In the prior art, there is no waste heat boiler which combines the fin structure of the heating tube with the dedusting device, so as to effectively recover various grades of exhaust gases in which the temperature is 300° C. to 500° C., the dust concentration is 10 g/Nm3 to 100 g/Nm3, and the dusts have high adhesiveness, while the heat transfer performance is high and the cost is low.

SUMMARY OF THE INVENTION

One technical problem to be solved by the present invention is to provide a waste heat boiler, a hammering device thereof, and a heating tube mounting structure, which can exert a sufficient hammering function and improve the dedusting effect; meanwhile, the hammering force causes a small impact on surrounding accessories, and the durability of the equipment is good.

Another technical problem to be solved by the present invention is to provide a waste heat boiler, a hammering device thereof, and a heat conduction tube mounting structure, which have a high heat transfer performance and a good dedusting effect without increasing the cost, and can be used to recover various grades of exhaust gases.

A first invention of the present invention is to provide a waste heat boiler, characterized in that: heat tubes are connected to support assemblies in an unfixed way. Thus, when being hammered by the hammering device, the heating tubes can move relative to the support assemblies so as to achieve a sufficient hammering. In addition, since the heating tubes are not fixed to the support assemblies, the influence on the support assemblies by the hammering impact force is weakened, and the durability of equipment is good.

1) The heating tubes pass through support hole portions of the support assembly.

2) Two or more support assemblies are arranged in an axial direction of the heating tube at an interval, and one of the heating tubes passes through corresponding two or more support hole portions of the two or more support assemblies.

3) The support assembly comprises a plurality of support rings corresponding to each of the heating tubes and support beams for fixing the support rings, a hole of the support ring constituting the support hole portion; or the support assembly comprises a support plate which includes via-holes corresponding to each of the heating tubes and constituting the support hole portion; or the support assembly comprises a rod component which includes meshes corresponding to each of the heating tubes and constituting the support hole portion. In the present invention, the support assembly has a simple structure, and the mounting operation of the heating tubes is convenient.

4) Fins are provided on a surface of the heating tube.

5) The heating tubes are horizontally arranged, the fins are perpendicularly provided on an outer peripheral surface of the heating tube and radially protruded outwards along the whole peripheral surface of the outer peripheral surface, and a plurality of fins are provided in an axial direction of the heating tube.

6) The heating tubes are vertically arranged, the fins are perpendicularly provided on an outer peripheral surface of the heating tube and protruded in an axial direction of the heating tube, and the fins are discontinuous in the axial direction.

The main heat exchange surface of the fin is in the same direction as the dust gravity, and the dusts will not be easily adhered. In addition, the main heat exchange surface of the fin is in the same direction as the exhaust gas flow, and the energy consumption is low.

7) The heating tubes are in a grid arrangement; a plurality of heating tubes adjacent to each other in a same horizontal plane constitute a heat transfer assembly, and the waste heat boiler comprises a plurality of heat transfer assemblies arranged in parallel with each other in the up and down direction; or a plurality of heating tubes adjacent to each other in a same vertical plane constitute a heat transfer assembly, and the waste heat boiler comprises a plurality of heat transfer assemblies arranged in parallel with each other in the vertical direction; the waste heat boiler comprises a plurality of hammering devices each corresponding to one of the heat transfer assemblies. The structure of rapping in bundles in the present invention can achieve a sufficient rapping, without brining any burden to the heating tubes and the mounting fittings, and further improve durability of equipment.

8) The hammering device comprises a hammering rod connected to each of the heat transfer assemblies and a hammering assembly for rapping the hammering rod; the hammering assembly comprises a hammering shaft, a hammer fixed to the hammering shaft, and a driving motor connected to the hammering shaft to control the hammering shaft for a reciprocation rotation.

9) The hammer is corresponding to an end portion or a lateral side of the hammering rod.

10) The waste heat boiler further comprises a soot blowing device. The soot blowing device can be started when exhaust gas containing the dusts of low concentration and small particle sizes is to be recovered.

11) The soot blowing device comprises an air station, a connection pipe and a plurality of element pipe; the element pipe are horizontally arranged and located above the heating tube; an axis of the element pipe is perpendicular to an axis of the heating tube; the element pipe is connected to a lance tube; one end of the lance tube is connected to a control device capable of driving the lance tube to protrude forward or retract backward; a lower portion of each of the element pipe is provided with gas injection holes corresponding to the each of heating tubes. The soot blowing device of the present invention has a simple structure, which can effectively process the dusts attached to the finned heating tubes to avoid blocking, and ensure that the heating tubes have a high heat transfer performance, thereby improving the heat recovery efficiency of the boiler.

12) The control device comprises a motor and a mating gear connected thereto; one end of the lance tube passes through a wall of the boiler and extends outside; the one end of the lance tube is set as a screw structure; the mating gear is meshed with the screw structure; and a rotation direction of the mating gear is different with a rotation direction of the motor, thereby controlling the protruding and retracting of the lance tube.

A second invention of the present invention is to provide a waste heat boiler, comprising a boiler, and heating tubes provided in the boiler and a hammering device, the boiler being provided with an exhaust gas inlet and an exhaust gas outlet, characterized in that: a surface of the heating tube is provided with fins, and the heating tubes are connected to support assemblies in an unfixed way. In the case of a staggered arrangement of the finned tubes, a low heat transfer efficiency and blocking will be caused due to the dust accumulation. In the case of a grid arrangement, the gas flow can be ensured, and blocking caused by the dust accumulation will not occur. Although the dust accumulation may occur between the heating tubes in the flow direction, heat exchanges can be performed on the surfaces of the fins, which ensure the whole heat transfer performance of the waste heat boiler. By combining the finned tubes with the heating tube mounting structure of the present invention, the heat exchange performance can be largely improved, without increasing the cost, and the rapping effect is better, so various grades of exhaust gases with a temperature of 300° C. to 500° C., a dust concentration of 10 g/Nm3 to 100 g/Nm3, and high adhesiveness can be effectively recovered.

A third invention of the present invention provides a hammering device of a waste heat boiler, comprising a hammering assembly that comprises a hammering shaft, a hammer fixed to the hammering shaft, and a driving motor connected to the hammering shaft to control the hammering shaft for a reciprocation rotation, characterized in that: the hammering device further comprises a hammering rod fixedly connected to a plurality of heating tubes adjacent to each other, and the heating tubes are connected to support assemblies in an unfixed way. The structure of rapping in bundles in the present invention can achieve a sufficient rapping, without brining any burden to the heating tubes and the mounting fittings, and further improve durability of equipment.

A fourth invention of the present invention provides a heating tube mounting structure of a waste heat boiler, characterized in that: the heating tubes are to support assemblies in an unfixed way. Thus a sufficient rapping can be achieved, without brining any burden to the heating tubes and the mounting fittings, and the durability of equipment is further improved.

In conclusion, the waste heat boiler and the hammering device thereof, and the heating tube mounting structure of the present invention can achieve sufficient rapping, and improve the dedusting effect. The hammering force causes a small impact on surrounding fittings, and the durability of equipment is good. In addition, a high heat transfer performance can be achieved without increasing the cost, and various grades of exhaust gases can be recovered. The waste heat boiler is capable of recovering the exhaust gases in various industries and it is highly universal.

DETAILED DESCRIPTION OF THE PREFERRED EMBODIMENTS

Next, a waste heat boiler, a hammering device and a heating tube mounting structure provided by the present invention will be described with reference to the drawings. In which, the hammering device and the heating tube mounting structure are components of the waste heat boiler; the examples of the hammering device and the heating tube mounting structure will be included in the examples of the waste heat boiler, and are not described separately. The waste heat boiler of the present invention can be used to recover the exhaust gas for the industries such as cement production, carbon black production, glass fiber production, metallurgy steel production, petroleum production, acid and alkali production, etc.

EMBODIMENT 1

The present invention provides a waste heat boiler, a hammering device thereof, and a heating tube mounting structure. The main invention principle of the present invention is to combine the fin structure of the finned heating tube with the hammering device to deal with the high temperature waste heat and the highly adhesive dusts in the industrial exhaust gas, thereby effectively recovering various grades of exhaust gases in which the temperature is 300° C. to 500° C., the dust concentration is 10 g/Nm3 to 100 g/Nm3, and the dusts have high adhesiveness in a dry state. In addition, the waste heat boiler also has the characteristics of high heat transfer performance, low cost, and effective cleaning of adhered dusts.

Figure 1:
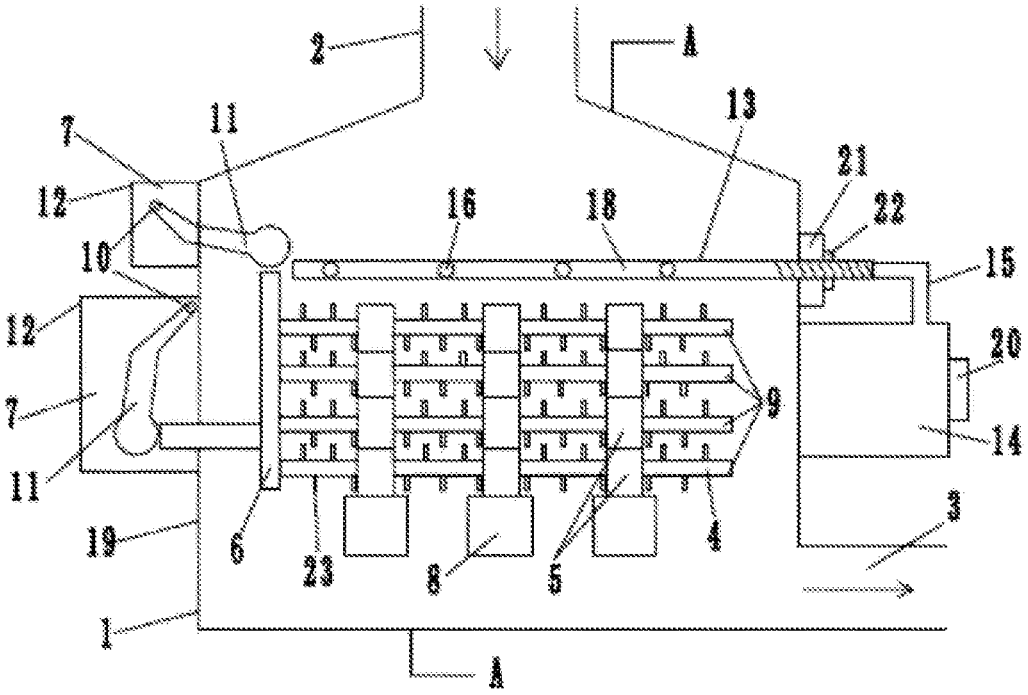
FIG. 1 is a structural diagram of Embodiment 1 of the present invention.

As illustrated in FIG. 1, the waste heat boiler in the embodiment is a vertical structure, comprising a boiler 1, and an exhaust gas inlet 2 and an exhaust gas outlet 3 are provided at an upper portion and a lower portion of the boiler 1, respectively.

Figure 2:
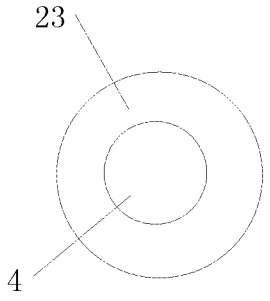
FIGS. 2 to 4 are structural diagrams of fins of a heating tube in Embodiment 1 of the present invention.
Figure 3:
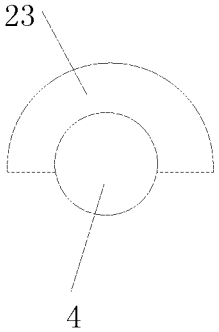
Figure 4:
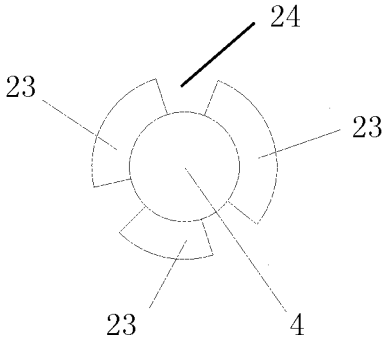

As an important technical feature of the present invention, a plurality of heating tubes 4 with fins 23 are provided in the boiler 1. The heating tubes 4 are arranged into a horizontal and grid tube arrangement, thus dusts that might by accumulated between the fins 23 can be blown off during the uniform flow of the exhaust gas from top to bottom as indicated by the arrow, thereby obviously increasing the amount of heat transferred from the exhaust gas to the heating tube 4, and improving the efficiency for the whole boiler to recover the waste heat of the exhaust gas. By using the heating tube 4 with the fins 23, the heat exchange area can be efficiently expanded, and the heat exchange performance can be increased, without increasing the cost. As illustrated in FIGS. 2 to 4, the fin 23 is provided as being perpendicular to an outer peripheral surface of the heating tube 4 and radially protruded outwards along the outer peripheral surface. On the periphery of one heating tube 4, a plurality of fins 23 are provided at an interval along a length direction, i.e., an axial direction. In a preferred embodiment, as illustrated in FIG. 2, the fin 23 is provided on the whole outer peripheral surface of the heating tube 4, i.e., the fin 23 is a closed annular piece. Since the fin 23 perpendicularly winds on the outer peripheral surface of the heating tube 4, the main heat exchange surface of the fin 23 is in the same direction as the dust gravity. Thus it is difficult for the dusts to be accumulated between the fins 23, and the flow direction of the exhaust gas is the same as the setting direction of the fin 23, which leads to a small energy consumption. The closed annular fin 23 can maximize the heat exchange area, and the heat exchange area can be adjusted by varying the number, interval, height and thickness of the fins 23 provided in the length direction of the heating tube 4. In an optional example, as illustrated in FIGS. 3 and 4, the closed annular fin 23 may be replaced by two or more discontinuous sector pieces. Although the heat exchange area for these fins 23 is reduced, the gap 24 between the sector pieces allows the exhaust gas to flow through, thereby increasing the amount of heat transferred from the exhaust gas to the heating tube 4 at certain extent.

Figure 5:
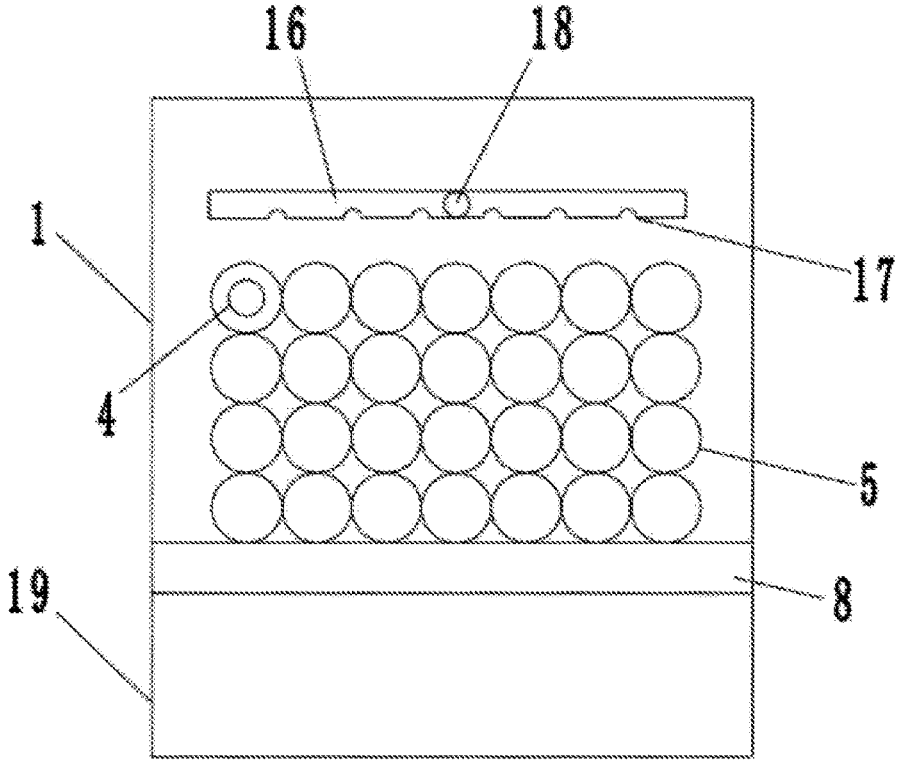
FIG. 5 is a view of FIG. 1 in direction A-A.

Another important technical feature of the present invention is the heating tube mounting structure related to the hammering device. As illustrated in FIGS. 1 and 5, in one example of the present invention, two or more support assemblies are arranged in an axial direction of the heating tube 4 at an interval. One heating tube 4 passes through corresponding two or more support hole portions of the two or more support assemblies. Of course, one support assembly may be provided at a central portion of the heating tube 4 in the axial direction, and two ends of the heating tube 4 are supported movably by other supports. In a preferred example, the support assembly for supporting the heating tube 4 includes a plurality of support rings 5 corresponding to each of heating tubes 4 and support beams 8 for fixing these support rings 5. The hole of the support ring 5 constitutes the support hole portion. In a case where the heating tubes 4 are in a grid tube arrangement, the support rings 5 are also in a grid tube arrangement. Two or more support assemblies are provided in the length direction of the heating tube 4 at an interval, and one heating tube 4 passes through corresponding support ring 5 of each support assembly. Thus, the heating tube 4 is connected to the support ring 5 of the support assembly in an unfixed way, and a gap 24 between the outer peripheral surface of the heating tube 4 and the inner peripheral surface of the support ring 5 allows the heating tube 4 and the support ring 5 to move relative to each other. Through the heating tube mounting structure in the embodiment, the heat conduction tube 4 is movably and freely mounted. Under the hammering effect of the hammering device, the heating tube 4 and the support ring 5 can move relative to each other, and a sufficient vibration can be achieved. In addition, the hammering impact force will not bring any burden to the support assembly, and the durability of equipment is improved.

Figure 6:
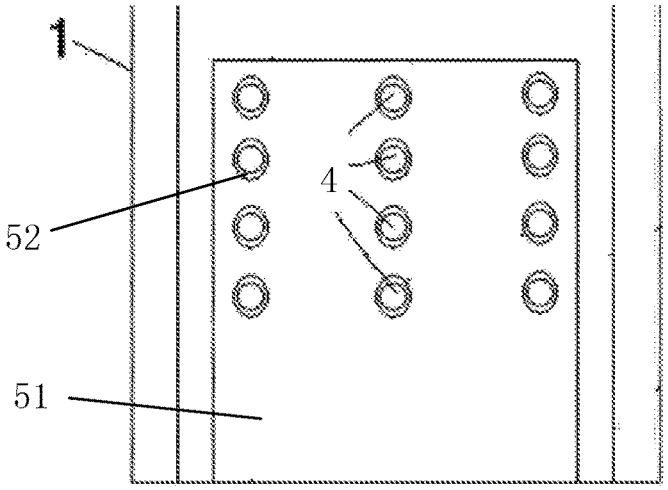
FIG. 6 is a schematic diagram of an example of a heating tube mounting structure in Embodiment 1 of the present invention (fins are not illustrated)

In another preferred example, as illustrated in FIG. 6, the support assembly comprises two or more support plates 51 provided in the length direction of the heating tube 4 at an interval; each support plate 51 is provided with a via-hole 52 corresponding to a respective heating tube 4; one heating tube 4 passes through corresponding open holes 52 of the plurality of support plates 51; the open holes 52 constitute the support hole portions; and the support plate 51 is consistent with the flow direction with the exhaust gas, thus the energy consumption is small.

Figure 7:
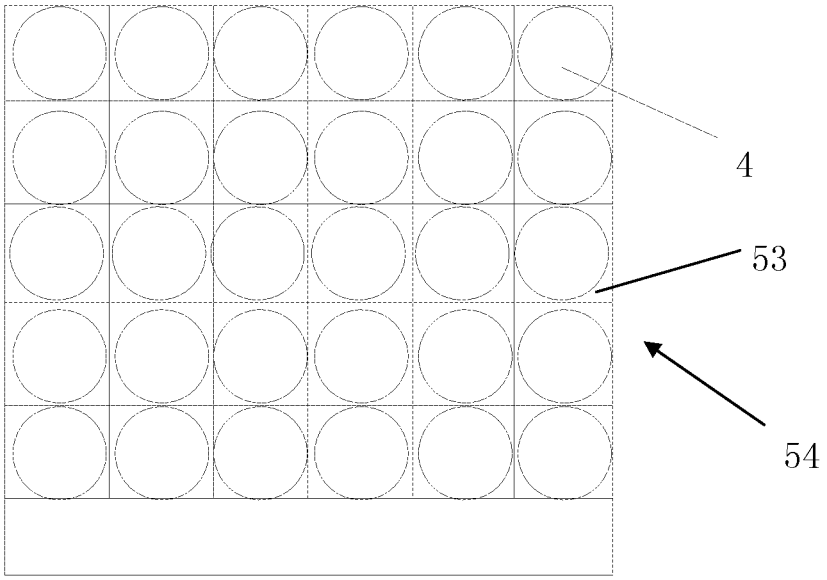
FIG. 7 is a schematic diagram of another example of a heating tube mounting structure in Embodiment 1 of the present invention (fins are not illustrated)
Figure 8:
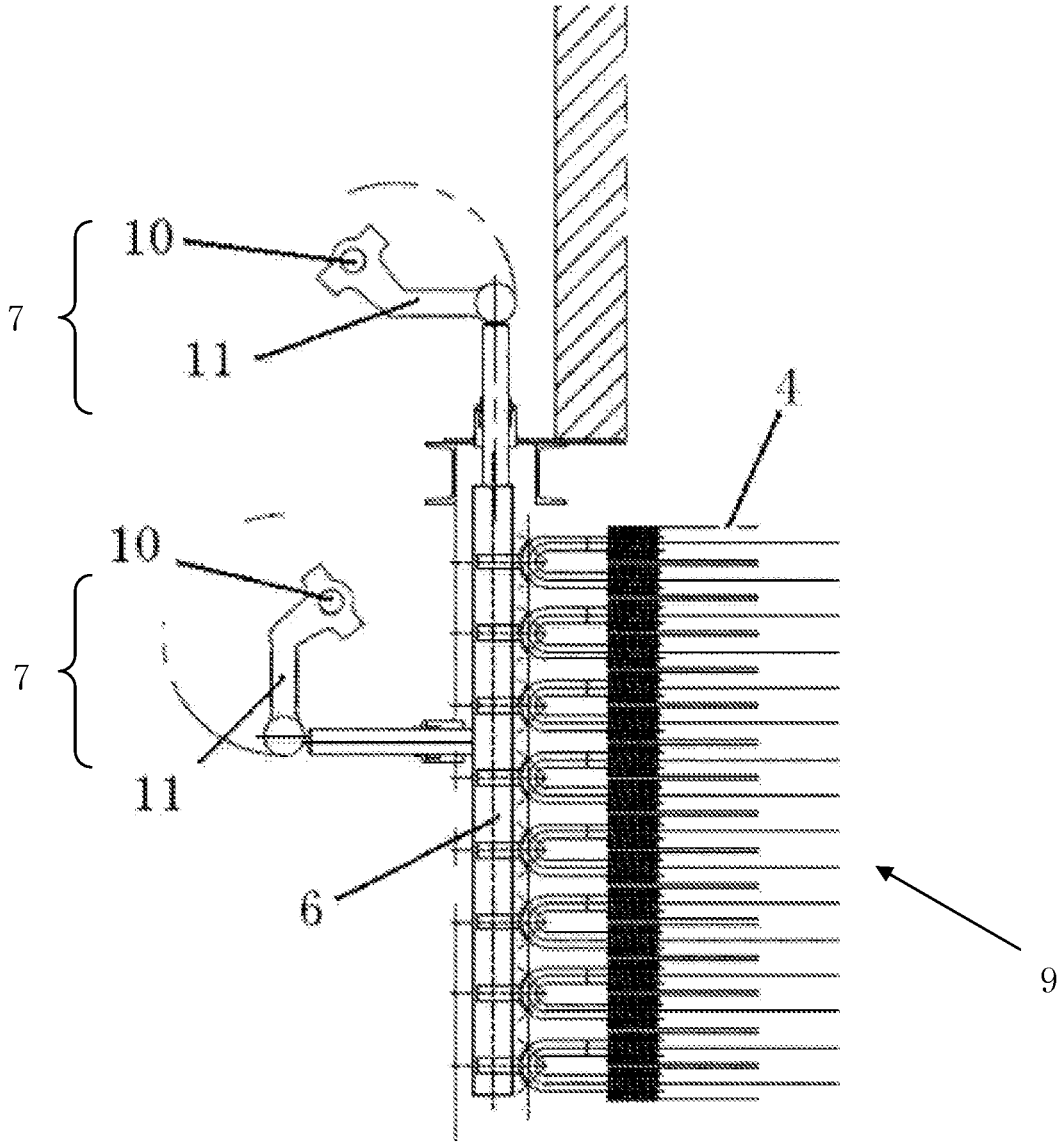
FIG. 8 is a schematic diagram of a hammering device in Embodiment 1 of the present invention.

The above two examples provide the structures for movably mounting the heating tubes 4 with the support rings 5 and the open holes 52. It is conceivable that in an optional example, as illustrated in FIG. 7, the heating tubes 4 can be movably supported by metal rod assemblies 54 having meshes 53, and the meshes 53 constitute the support hole portions, provided that the size of the mesh 53 is larger than that of the outer peripheral surface of the heating tube 4. Of course, the support assembly capable of movably supporting the heating tube 4 is not limited to the structures in the above examples, and any structure that realizes a movable mounting of the heating tube 4 can be used. In extreme cases, the heating tubes may be suspended in the boiler using metal chains. Herein the details are no longer described.

The inventor carries out a test in which exhaust gas from a PH tower of a cement kiln flows in a test apparatus assumed as a PH boiler. The heating tubes 4 with fins 23 have an outer diameter of 38 mm, a horizontal grid tube arrangement, an interval of 90 mm in a perpendicular direction perpendicular to the flow direction of the exhaust gas, an interval of 90 mm in a flow direction of the exhaust gas, a fin 23 height of 21 mm, a fin 23 thickness of 1.2 mm, and are internally cooled with warm water. Here no dedusting device is provided, so as to determine the dynamic condition of dust accumulation. The pressure loss and dust accumulation situation of the heating tubes 4 are tested by varying the interval of the fins 23, so as to determine the heat transfer performance. The test result shows that the dust accumulation situation (assessed with a ratio of a pressure loss in a stable state to a pressure loss in an initial stage) in the same degree as that of the existing PH boiler (the heating tubes are in a perpendicular staggered tube arrangement, wherein the outer diameter of the bare tube is 38 mm, the interval in the perpendicular direction of the exhaust gas is 90 mm, and the interval in the flow direction of the exhaust gas is 78 mm) can be obtained by setting the interval of the fins 23 to be more than 15 mm, such as 15 mm to 18 mm. It is also determined that the dust accumulation amount is saturate by optimizing the arrangement of the heating tubes 4 and the interval of the fins 23, and a stable running under the exhaust gas of a high dust concentration is achieved through a cooperation with the dedusting device.

In one example, the waste heat boiler of the present invention may be not provided with a hammering device, and the dedusting may be made through manual hammering or an additional external hammering device. In a preferred example, the waste heat boiler of the present invention is provided with a hammering device. The structure of the hammering device may be any hammering device in the prior art. Based on the heating tube mounting structure in the present invention and relative to the heating tube mounting structure in the prior art, an improved hammering effect can be achieved using any existing hammering device. In a preferred example of the present invention, the heating tubes 4 are hammered in bundles using a hammering device specially designed in the present invention.

Firstly, the heating tubes 4 are divided into bundles, and the specific manner of dividing into bundles is as follows. In a case where the heating tubes 4 are in a horizontal grid tube arrangement, a plurality of heating tubes 4 adjacent to each other in a same vertical plane constitute a heat transfer assembly 9. In that case, as illustrated in FIG. 1, the waste heat boiler includes a plurality of heat transfer assemblies 9 parallel to each other in the vertical direction. In addition, a plurality of heating tubes 4 adjacent to each other in a same horizontal plane may also be selected to constitute a heat transfer assembly 9. Of course, in a case where the heating tubes 4 are in a staggered tube arrangement, a plurality of heating tubes adjacent to each other in a certain inclined plane may constitute a heat transfer assembly and the waste heat boiler comprises a plurality of heat transfer assemblies parallel with each other in the inclined direction.

The hammering device of the present invention for hammering the heating tubes in bundles is described as follows.

The hammering device of the waste heat boiler of the present invention comprises a hammering rod 6 connected to the heat transfer assembly 9, and a hammering assembly 7 capable of rapping the hammering rod 6. Each heat transfer assembly 9 is provided with a hammering rod 6. The hammering assembly 7 comprises a horizontally arranged hammering shaft 10, a hammer 11 fixed to the hammer shaft 10, and a driving motor 12 connected to the hammer shaft 10 and capable of controlling the hammer shaft 10 for a reciprocation rotation at a preset speed. Each hammer 11 is arranged at an upper portion or a lateral side of the hammering rod 6. In such a structure, each hammer 11 is corresponding to one hammer rod 6, and a plurality of hammers 11 act consistently along with the rotation of the hammering shaft 10 to achieve effective rapping and dedusting for each heat transfer assembly 9, thereby ensuring the processing of the high-concentration dusts, and preventing the dusts from being accumulated in the heating tubes 4 and the fins 23.

It is conceivable that in one example, the hammer 11 may not hammer the hammering rod 6, while being corresponding to the support assembly, i.e., hammering the support assembly such as the support plate 51, and a good hammering effect can also be achieved. For the waste heat boiler which has a limited design space, hammering the support plate also provides a choice for designing the hammering device.

In one example, it is not limited to the manner of dividing the heating tubes 4 into bundles based on the heat transfer assembly 9, and the hammering rod 6 can be connected to any number of heating tubes 4 adjacent or not adjacent to each other, just by varying the specific shape of the hammering rod 6. For example, as illustrated in FIG. 5, four adjacent heating tubes 4 at the upper right are connected to a rectangular hammering rod 6 for hammering in bundles, which is omitted herein.

As compared with the existing structure in which the hammering device of the PH boiler raps the whole tube bundles, a better hammering effect can be obtained by rapping each tube bundle, i.e., the heat transfer assembly 9 as described in the present invention. The hammering impact force caused by rapping in bundles will not bring any burden to the heating tubes 4 and the mounting accessories, and the durability is better.

The inventor carries out the durability test and the vibration measurement using a hammering device in the same size as the real object. A test of rapping the hammering rod 6 connected to the heating tube 4 from the top and a test of transversely rapping the hammering rod 6 from the lateral side are performed using the interval of the fins 23 and the arrangement of the heating tubes 4 used in the test where exhaust gas from the PH tower of the cement kiln flows in a test apparatus assumed as the PH boiler. The hammering rod 6 is rapped using three types of hammers (large, middle and small) of different hammering forces. As can be determined from the vibration measurement, an impact force damaging the device is caused when the large hammer is used, and a vibration of the heating tubes larger than that in the existing PH boiler will be generated whatever the size of the hammer. In the durability test, it is determined that the durability is more than one million times of continuous rapping. In addition, it is determined that by selecting an optimum hammer in the structure, a better dedusting effect can be achieved, and a stable operation can be performed.

In order to deal with dusts of a low concentration and small particle sizes, for example to recover exhaust gas of a ferrosilicon manufacturing electric furnace with a dust concentration of 10 g/Nm3. In a preferred example of the present invention, a soot blowing device may be provided for dedusting in substitution of the hammering device when necessary. The soot blowing device may be any soot blowing device in the prior art.

In a preferred example of the present invention, as illustrated in FIGS. 1 and 5, the soot blowing device 13 comprises an air station 14, a connecting pipe 15, element pipe 16, a lance tube 18 and a control device 20. The element pipe 16 is horizontally arranged and located above the heating tube 4. The axis of the element pipe 16 forms a right angle with the axis of the heating tube 4. The element pipe 16 is connected to the horizontally arranged lance tube 18. One end of the lance tube 18 is connected to a control device 20 capable of driving the lance tube 18 to protrude forward or retract backward. The plane under each element pipe 16 is provided with gas injection holes 17 at an interval. The angle of the element pipe 16 is adjustable.

A control component 20 comprises a motor 21 and a mating gear 22 connected to the motor 21. One end of the lance tube 18 passes through a boiler wall 19, and extends out of the boiler wall 19. The structure of that one end is a screw structure. The mating gear 22 is meshed with the screw structure, and the rotation direction of the mating gear 22 is different with the rotation direction of the motor 21, thereby controlling the protrusion and retraction of the lance tube 18. The structure is simple, the performance is stable and reliable when the lance tube 18 is operated to drive the element pipe 16 and the fault will not easily occur. When the soot blowing device 13 needs to work, the lance tube 18 is controlled to protrude forward or retract backward through the control component 20, driving the element pipe 16 to move forward and backward. The gas injection holes 17 on the element pipe 16 jets high pressure gas from above downward for cleaning the dusts accumulated on the heating tube 4 and the fin 23.

In the present invention, a movable soot blowing device 13 is provided above the heating tube 4, so as to blow dusts downward from the space between the heating tubes 4. The soot blowing device 13 of the present invention not only has a simple structure, but also effectively processes the adhesiveness dusts on the heating tube 4 with the fins 23 to avoid them being blocked, thereby ensuring that the heating tube has a high heat transfer performance, and improving the heat recovery efficiency of the boiler.

In the present invention, owing to the effective works of the hammering device and the soot blowing device, the fins 23 may be provided on the heating tube 4, which effectively expands the heat transfer area, improves the heat transfer performance, and efficiently reduces the cost of the heating tube and the whole boiler, without increasing the volume or number of the heating tube.

In order to recover the high or ultra-high temperature exhaust gas, in a preferred example, the number of the heat transfer assemblies 9, i.e., the number of the heating tubes may be further increased, so as to expand the heat transfer area of the heating tubes in the boiler, and improve the entire heat recovery efficiency of the waste heat boiler.

Of course, in an optional example, the heating tube mounting structure of the present invention can be used. Meanwhile, the hammering effect can also be improved by rapping the whole bundles of all the heating tubes of the waste heat boiler using the existing hammering device.

The waste heat boiler of the present invention overcomes the technical prejudice that the fin structure of the heating tube is not combined with the hammering device to deal with the dusts in the prior art. By designing the fin structure and combining the hammering device with the soot blowing device, a waste heat boiler with a high heat transfer performance, a low cost and a stable operation is obtained, which can recover the high or ultra-high temperature dusts of various concentrations and high adhesiveness. The horizontally arranged heating tubes with the fins are used and parallel to each other (grid tube arrangement). As to the dusts of high concentration and large particle sizes, the ends of a certain number of heating tubes are fixedly connected through the hammering rod of the hammering device, and then the uppermost portion or the lateral side of the hammering rod is rapped, so that dedusting by rapping for a plurality of heating tubes is achieved by arranging a hammering assembly. As to the dusts of low concentration and small particle sizes, such as those in exhaust gas of a ferrosilicon manufacturing electric furnace, a movable soot blowing device 13 is provided above the heating tube, so as to blow dusts downward from the space between the heating tubes. The waste heat boiler of the present invention not only has a simple structure, but also effectively processes the adhesiveness dusts on the heating tube with the fins to avoid them being blocked, thereby ensuring that the heating tube has a high heat transfer performance, and improving the heat recovery efficiency of the boiler.

EMBODIMENT 2

Figure 9:
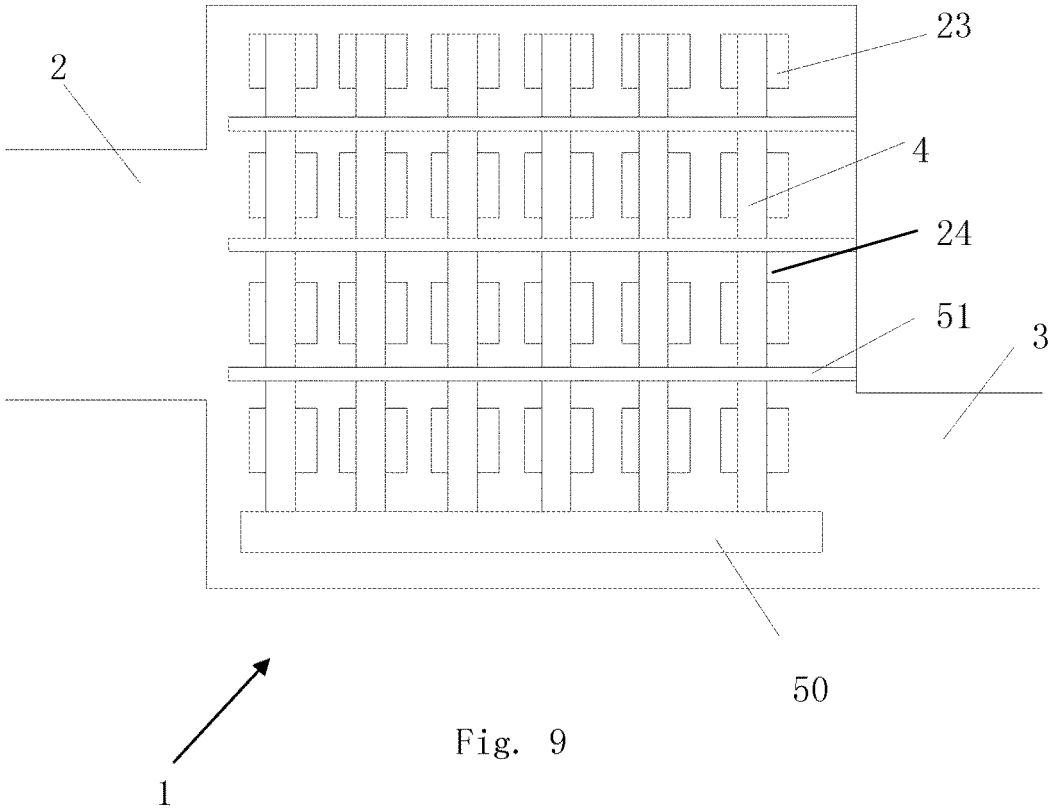
FIG. 9 is a structure diagram of Embodiment 2 of the present invention (a hammering device, a soot blowing device, etc. are not illustrated)
Figure 10:
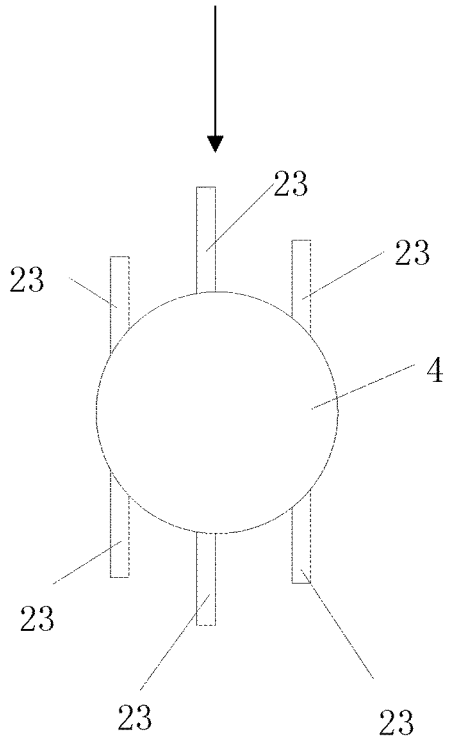
FIG. 10 is a structure diagram of fins of a heating tube in Embodiment 2 of the present invention.

As illustrated in FIGS. 9 and 10, the principle of this embodiment is the same as that of Embodiment 1; the heating tube mounting structure, the hammering device and the soot blowing device have the same structures as those in Embodiment 1, and the bundling manner of heating tubes is also the same as that in Embodiment 1, which are omitted herein. The differences lie in that the waste heat boiler is horizontal, the heating tubes 4 are in a vertical grid tube arrangement, and the lower end portion of the heating tube 4 can be placed on a certain support 50.

As illustrated in FIGS. 9 and 10, in this embodiment, the left and right portions of the boiler 1 are provided with an exhaust gas inlet 2 and an exhaust gas outlet 3, respectively. The heating tube 4 orderly passes through a plurality of open holes 52 (not illustrated) of the support plate 51 serving as the support hole portions arranged in the up and down direction. The fins 23 on the heating tube 4 are perpendicular to the outer peripheral surface of the heating tube 4 and protruded in the axial direction of the heating tube. In a preferred example, the fins 23 are provided as being substantially consistent with the flow direction of the exhaust gas indicated by the arrow. That is, the fins 23 are provided at opposite two sides upstream and downstream the exhaust gas flow of the heating tube 4 and no fin 23 is provided at the two sides of the heating tube 4 perpendiculars to the exhaust gas flow, so as to avoid energy loss. In a preferred example, the fins 23 are discontinuous in the axial direction, i.e., a plurality of segments of fins 23 are provided in the length direction of the heating tube, such that the exhaust gas passes through the gap 24 between the fins 23, thereby increasing the amount of heat transfer between the exhaust gas and the heating tube. In addition, the gap 24 between the fins 23 can be used as a place for cooperation with the support assembly. Of course, continuous fins 23 in the axial direction can also be used.

In this embodiment, although the heating tubes 4 are vertically arranged, the surface of the heating tube 4 and the surface of the fin 23 are still in the same direction with the dust gravity, and the dusts will not be easily adhered. The hammering device can rap the upper end of the heating tube 4 or the support assembly.

Based on this embodiment, the same effect as that of Embodiment 1 can be achieved and it is omitted herein.

EMBODIMENT 3

Based on Embodiments 1 and 2, the waste heat boiler of this embodiment uses the same heating tube mounting structure, rapping device and soot blowing device as those in Embodiments 1 and 2. The differences lie in that the finned tubes in Embodiments 1 and 2 are replaced with the bare tubes. Although the heat exchange performance is degraded at some extent, this embodiment still can achieve excellent hammering effect. Thus, the existing PH waste heat boiler can be improved to recover the exhaust gas with a high temperature of 300° C. to 500° C., a dust concentration of 10 g/Nm3 to 100 g/Nm3, and high adhesiveness.

EMBODIMENT 4

Based on Embodiments 1 and 2, the waste heat boiler of this embodiment uses the same heating tube mounting structure as that in Embodiments 1 and 2. The difference lies in that the heating tubes with fins in Embodiments 1 and 2 are replaced with the spiral fin heating tubes in the prior art, i.e., the AQC waste heat boiler with the spiral fin heating tubes is improved with the heating tube mounting structure of the present invention. Based on the heating tube mounting structure of the present invention, an excellent hammering effect can be achieved. In combination with the hammering device and the soot blowing device, the exhaust gas with a high temperature of 300° C. to 500° C., a dust concentration of 10 g/Nm3 to 100 g/Nm3, and high adhesiveness can also be effectively recovered.

As to the existing AQC waste heat boiler, since it usually does not include the hammering device, in one example, only the heating tube mounting structure of the AQC waste heat boiler is replaced with the mounting structure of the present invention, and a hammering device is additionally provided.

Other Modification

The fins 23 perpendicularly provided on the outer peripheral surface of the heating tube 4 and protruded along the outer peripheral surface, as illustrated in FIGS. 2 to 4 in Embodiment 1, can also be applied to the vertically arranged heating tubes. The fins 23 perpendicularly provided on the outer peripheral surface of the heating tube 4 and protruded along the axial direction of the heating tube 4, as illustrated in FIGS. 9 to 10 can also be applied to the horizontally arranged heating tubes. The spiral fins can be applied to the vertically or horizontally arranged heating tubes.

The above descriptions are just specific embodiments of the present invention, and the implementation range of the present invention cannot be defined thereto. Any equivalent change or modification made based on the Summary of the present invention (e.g., any other person uses the fin structure of the heating tube of the present invention, the movable heating tube mounting structure of the present invention, or the hammering device rapping in bundles of the present invention, or combines the finned heating tube with the hammering device) shall fall within the protection scope of the present invention.

The invention claimed is:

1. A waste heat boiler comprising:

a boiler having an exhaust gas inlet and an exhaust gas outlet; and a plurality of heating tubes disposed in the boiler, the plurality of heating tubes being disposed within a plurality of support assemblies such that the plurality of heating tubes are supported by the plurality of support assemblies without being affixed to the plurality of support assemblies and are configured to move freely relative to the plurality of support assemblies, the plurality of support assemblies including:

a plurality of support rings corresponding to respective heating tubes of the plurality of heating tubes, each heating tube of the plurality of heating tubes being disposed within a hole of a corresponding support ring of the plurality of support rings, and a plurality of support beams only disposed below all of the support rings with respect to a vertical direction of the boiler, the plurality of support beams being configured to maintain the plurality of support rings in a fixed position, wherein a gap between an outer peripheral surface of each heating tube and an inner peripheral surface of the corresponding to a respective support ring is configured to allow the heating tube and the support ring to move relative to each other.

2. The waste heat boiler according to claim 1, wherein the plurality of support assemblies are arranged in an axial direction of the plurality of heating tubes at an interval.

3. The waste heat boiler according to claim 1, further comprising a plurality of fins disposed on an outer peripheral surface of each heating tube of the plurality of heating tubes.

4. The waste heat boiler according to claim 3, wherein:

the plurality of heating tubes are horizontally arranged, the plurality of fins protrude perpendicularly from the outer peripheral surface of each heating tube of the plurality of heating tubes and radially protrude outwards along the entire peripheral surface of the outer peripheral surface of each heating tube of the plurality of heating tubes, and the plurality of fins (i) are disposed in an axial direction of each heating tube of the plurality of heating tubes, or (ii) are spiral in shape.

5. The waste heat boiler according to claim 1, wherein:

the plurality of heating tubes are vertically arranged with respect to the boiler, the plurality of fins protrude perpendicularly from an outer peripheral surface of each heating tube of the plurality of heating tubes and protrude in an axial direction of each heating tube, and the plurality of fins (i) are discontinuous in the axial direction, or (ii) are spiral in shape.

6. The waste heat boiler according to claim 4, wherein:

the plurality of heating tubes are in a grid tube arrangement, each set of heating tubes of the plurality of heating tubes adjacent to each other in a same vertical plane forms a heat transfer assembly of a plurality of heat transfer assemblies, and the waste heat boiler further comprises a plurality of hammering devices, each hammering device of the plurality of hammering devices corresponding to the heat transfer assemblies of the plurality of heat transfer assemblies.

7. The waste heat boiler according to claim 6, wherein:

each hammering device includes (i) a hammering rod connected to each of the heat transfer assemblies, and (ii) a hammering assembly configured to rap the hammering rod; and the hammering assembly of each hammering device includes a hammering shaft, a hammer fixed to the hammering shaft, and a driving motor connected to the hammering shaft and configured to control the hammering shaft for a reciprocating rotation.

8. The waste heat boiler according to claim 7, wherein the hammer corresponds to an end portion or a lateral side of the hammering rod.

9. The waste heat boiler according to claim 1, further comprising a soot blowing device.

10. The waste heat boiler according to claim 9, wherein:

the soot blowing device includes an air station, a connecting pipe, and a plurality of element pipes, the plurality of element pipes are horizontally arranged and disposed above the plurality of heating tubes, an axis of each element pipe of the plurality of element pipes is perpendicular to an axis of the heating tube, and each element pipe of the plurality of element pipes is connected to a lance tube;

one end of the lance tube is connected to a control device configured to drive the lance tube to protrude forward or retract backward, the control device including a motor connected to a mating gear;

a lower portion of each element pipe of the plurality of element pipes is provided with a plurality of gas injection holes corresponding to each of the heating tubes;

a first end of the lance tube passes through a wall of the boiler and extends outside of the boiler, the first end of the lance tube having a screw;

the mating gear is meshed with the screw of the lance tube; and a rotation direction of the mating gear is different than a rotation direction of the motor, such that the protruding and retracting of the lance tube is controlled.

11. The waste heat boiler according to claim 3, wherein:

the plurality of heating tubes are in a grid tube arrangement, each set of heating tubes of the plurality of heating tubes adjacent to each other in a same vertical plane forms a heat transfer assembly of a plurality of heat transfer assemblies, the plurality of heat transfer assemblies are arranged in parallel relative to a vertical direction, and the waste heat boiler further comprises a plurality of hammering devices, a hammering device of the plurality of hammering devices being configured to rap a heat transfer assembly of the plurality of heat transfer assemblies.

12. The waste heat boiler according to claim 5, further comprising a hammering device configured to rap a hammering rod connected to each heat transfer assembly of the plurality of heat transfer assemblies, the hammering device including a hammering shaft, a hammer fixed to the hammering shaft, and a driving motor connected to the hammering shaft and configured to control the hammering shaft with a reciprocating rotation.

13. The waste heat boiler according to claim 7, wherein the hammer is configured to rap an end portion or a lateral side of the hammering rod.

14. A waste heat boiler comprising:

a boiler having an exhaust gas inlet and an exhaust gas outlet; and a plurality of heating tubes disposed in the boiler, a surface of each heating tube of the plurality of heating tubes having a plurality of fins, the plurality of heating tubes being disposed within a plurality of support assemblies such that the plurality of heating tubes are supported by the plurality of support assemblies without being affixed to the plurality of support assemblies and are configured to move freely relative to the plurality of support assemblies, the plurality of support assemblies including:

a plurality of support rings corresponding to respective heating tubes of the plurality of heating tubes, each heating tube of the plurality of heating tubes being disposed within a hole of a corresponding support ring of the plurality of support rings, and a plurality of support beams only disposed below all of the support rings with respect to a vertical direction of the boiler, the plurality of support beams being configured to maintain the plurality of support rings in a fixed position, wherein a gap between an outer peripheral surface of each heating tube and an inner peripheral surface of the corresponding to a respective support ring is configured to allow the heating tube and the support ring to move relative to each other; and a hammering device.

15. The waste heat boiler according to claim 14, wherein:

the plurality of heating tubes are horizontally arranged, the plurality of fins are perpendicularly provided on an outer peripheral surface of each heating tube of the plurality of heating tubes and protrude radially outwards along the entire peripheral surface of the outer peripheral surface of each heating tube of the plurality of heating tubes, and the plurality of fins are provided in an axial direction of each heating tube of the plurality of heating tubes.

16. The waste heat boiler according to claim 14, wherein the plurality of support assemblies are arranged in an axial direction of the plurality of heating tubes at an interval.

* * * * *